US006866420B2

(12) United States Patent
Buchman

(10) Patent No.: US 6,866,420 B2
(45) **Date of Patent: *Mar. 15, 2005**

(54) RECLOSABLE PACKAGE HAVING A ZIPPER CLOSURE, SLIDER DEVICE AND TAMPER-EVIDENT STRUCTURE

(75) Inventor: James E. Buchman, Hortonville, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 11 days.

This patent is subject to a terminal disclaimer.

(21) Appl. No.: 10/397,587

(22) Filed: Mar. 26, 2003

(65) Prior Publication Data

US 2003/0185945 A1 Oct. 2, 2003

Related U.S. Application Data

(63) Continuation of application No. 10/245,879, filed on Sep. 17, 2002, now Pat. No. 6,572,266, which is a continuation of application No. 10/077,024, filed on Feb. 15, 2002, now Pat. No. 6,474,886, which is a continuation of application No. 09/621,599, filed on Jul. 21, 2000, now Pat. No. 6,347,885.

(60) Provisional application No. 60/176,872, filed on Jan. 18, 2000.

(51) Int. Cl.[7] ..... B65D 33/34

(52) U.S. Cl. ..... 383/5; 383/204; 383/210; 383/61.2; 383/64

(58) Field of Search ..... 383/5, 61.2, 203–204, 383/64, 210–211; 53/412; 493/213; 426/122

(56) References Cited

U.S. PATENT DOCUMENTS

| | | | |
|---|---|---|---|
| 3,790,992 | A | 2/1974 | Herz |
| 4,744,674 | A | 5/1988 | Nocek |
| 4,786,190 | A | 11/1988 | Van Erden et al. |
| 4,832,505 | A | 5/1989 | Ausnit et al. |
| 4,874,257 | A | 10/1989 | Inagaki |
| 4,923,309 | A | 5/1990 | Van Erden |
| 4,925,316 | A | 5/1990 | Van Erden et al. |
| 4,944,603 | A | 7/1990 | Cornish et al. |
| 4,966,470 | A | 10/1990 | Thompson et al. |
| 5,005,707 | A | 4/1991 | Hustad et al. |
| 5,121,997 | A | 6/1992 | La Pierre et al. |
| 5,127,208 | A | 7/1992 | Custer et al. |
| 5,131,121 | A | 7/1992 | Herrington, Jr. et al. |
| 5,224,779 | A | 7/1993 | Thompson et al. |
| 5,301,395 | A | 4/1994 | Richardson et al. |
| 5,442,837 | A | 8/1995 | Morgan |
| 5,456,928 | A | 10/1995 | Hustad et al. |
| 5,488,807 | A | 2/1996 | Terrenzio et al. |
| 5,669,715 | A | 9/1997 | Dobreski et al. |
| 5,713,669 | A | 2/1998 | Thomas et al. |
| 5,767,184 | A | 6/1998 | May |
| 5,875,611 | A | 3/1999 | Plourde |
| 5,911,508 | A | 6/1999 | Dobreski et al. |
| 5,924,795 | A | 7/1999 | Thompson et al. |
| 5,964,532 | A | 10/1999 | St. Phillips et al. |

(List continued on next page.)

FOREIGN PATENT DOCUMENTS

| | | |
|---|---|---|
| EP | 0528721 A2 | 2/1993 |
| EP | 0 941 937 A1 | 9/1999 |
| WO | WO 99/62781 | 12/1999 |
| WO | WO 00/67605 | 11/2000 |

*Primary Examiner*—Jes F. Pascua
(74) *Attorney, Agent, or Firm*—Tracey D. Beiriger; Eckert Seamans Cherin & Mellott

(57) ABSTRACT

A flexible, reclosable package having a reclosable zipper construction openable and closeable by a slider device, and a tamper-evident structure disposed over the zipper construction to provide indication whether access has been gained to the interior of the package. A second tamper-evident structure may be disposed between the zipper construction and the package interior. This second structure may be a web or a peel seal.

21 Claims, 6 Drawing Sheets

U.S. PATENT DOCUMENTS 6,010,244 A 1/2000 Dobreski et al.
6,131,369 A 10/2000 Ausnit
6,183,134 B1 2/2001 Malin
6,212,857 B1 4/2001 Van Erden
6,257,763 B1 7/2001 Stolmeier et al.
6,273,607 B1 8/2001 Buchman
6,290,390 B1 9/2001 Buchman
6,290,391 B1 9/2001 Buchman
6,290,393 B1 9/2001 Tomic
6,293,896 B1 9/2001 Buchman
6,327,837 B1 12/2001 Van Erden
6,347,885 B1 2/2002 Buchman
6,350,340 B1 2/2002 Johnson
6,354,738 B1 3/2002 Buckman et al.
6,357,914 B1 3/2002 Kinigakis et al.
6,360,513 B1 3/2002 Strand et al.
6,386,760 B1 5/2002 Tomic
6,390,676 B1 5/2002 Colombo et al.
6,412,254 B1 * 7/2002 Tilman et al. ..... 53/412
6,474,866 B2 11/2002 Buchman
6,572,266 B2 6/2003 Buchman
6,609,827 B2 8/2003 Bois et al.
6,609,828 B2 * 8/2003 Schneider et al. ..... 383/204
6,652,436 B1 * 11/2003 Yeager et al. ..... 493/213
6,688,080 B2 * 2/2004 Kinigakis et al. ..... 53/412
6,732,491 B2 * 5/2004 Buchman ..... 53/412
2002/0072460 A1 6/2002 Ausnit

* cited by examiner

RECLOSABLE PACKAGE HAVING A ZIPPER CLOSURE, SLIDER DEVICE AND TAMPER-EVIDENT STRUCTURE

CROSS REFERENCE TO RELATED APPLICATION

This application is a continuation of application Ser. No. 10/245,879, filed Sep. 17, 2002, issued as U.S. Pat. No. 6,572,266. Application Ser. No. 10/245,879 is a continuation of application Ser. No. 10/077,024, filed Feb. 15, 2002, issued as U.S. Pat. No. 6,474,886. Application Ser. No. 10/077,024 is a continuation of application Ser. No. 09/621,599, filed Jul. 21, 2000, issued as U.S. Pat. No. 6,347,885. Application Ser. No. 09/621,599 has priority under 35 U.S.C. § 119(e) to provisional application Ser. No. 60/176,872, filed Jan. 18, 2000, and entitled "Reclosable Package Having A Zipper Closure, Slider Device and Tamper-Evident Structure." The complete disclosures of application Ser. No. 10/245,879, application Ser. No. 10/077,024, application Ser. No. 09/621,599 and application Ser. No. 60/176,872 are incorporated by reference herein.

FIELD OF THE INVENTION

This disclosure concerns reclosable packages. In particular, this disclosure describes packages having slider devices for opening and closing the packages, and also having tamper-evident structures.

BACKGROUND OF THE INVENTION

Flexible packages, in particular resealable and recloseable packages, are frequently used for packaging of consumable goods (FIG. 6). Goods that are not used completely when the package is initially opened rely on a zipper closure to reclose the package and keep the remaining contents fresh. Examples of consumable goods that are often packaged in packages, such as bags, with a zipper closure include potting soil, fertilizer, pet food, dog biscuits, vegetables, cereal, and many different foods edible by humans.

Often, the opening and closing of the zipper closure is facilitated by a slider device that is mounted on the zipper closure. The slider device is constructed to pry apart the interlocking zipper closure members when the slider device is moved in a first direction along the zipper, and to engage the interlocking zipper closure members when the slider device is moved in a second, opposite direction along the zipper. For some applications, a tamper-evident structure, to notify whether access has been gained to the zipper closure, is desired. Improvements in these types of packages are desirable.

SUMMARY OF THE INVENTION

The present disclosure relates to a flexible bag, having a resealable, reclosable zipper closure mechanism, opening and closing of which is accomplished by a slider device. The slider device is constructed and arranged for mounting on the closure construction and for interlocking and disengaging the first mating profile with the second mating profile. When the slider device is moved in a first direction, the first mating profile is engaged to the second mating profile; when the slider device is moved in a second opposite direction, the first mating profile is disengaged from the second mating profile. A tamper-evident seal is provided on the exterior of the zipper closure so as to provide evidence whether access has been gained to the interior of the package. Additionally, an internal tamper-evident structure, such as a second tamper-evident structure or a peel seal can be included in the package.

In particular, the disclosure is directed to a flexible, reclosable package comprising first and second panel sections defining an interior. A zipper closure is sealed to each of first and second panel sections along a top edge of the package, the zipper closure extending from a first side edge to a second side edge and comprising first and second mating profiles. A slider device, constructed and arranged for mounting on the zipper closure and for interlocking the first mating profile with the second mating profile when the slider device is moved in a first direction and disengaging the first mating profile from the second mating profile when the slider device is moved in a second opposite direction, is operably mounted on the zipper closure. Disposed at the top edge and encasing a first portion of the zipper closure is a tamper-evident structure having an opening exposing the slider device, the opening defined by the tamper-evident structure.

Methods of making such a package, and methods of using such a package, are also disclosed.

DETAILED DESCRIPTION OF PREFERRED EMBODIMENTS

The addition of a slider device to a flexible package, such as a bag, is advantageous to aging or arthritic persons not having the physical ability to use just a zipper closure to reseal a bag. Additionally, the addition of a slider device to a flexible package facilitates the use of the bag by users of all ages and abilities. The presence of an external tamper-evident structure provides assurance that undesired access has not been gained to the interior and contents of the package.

Figure 1:
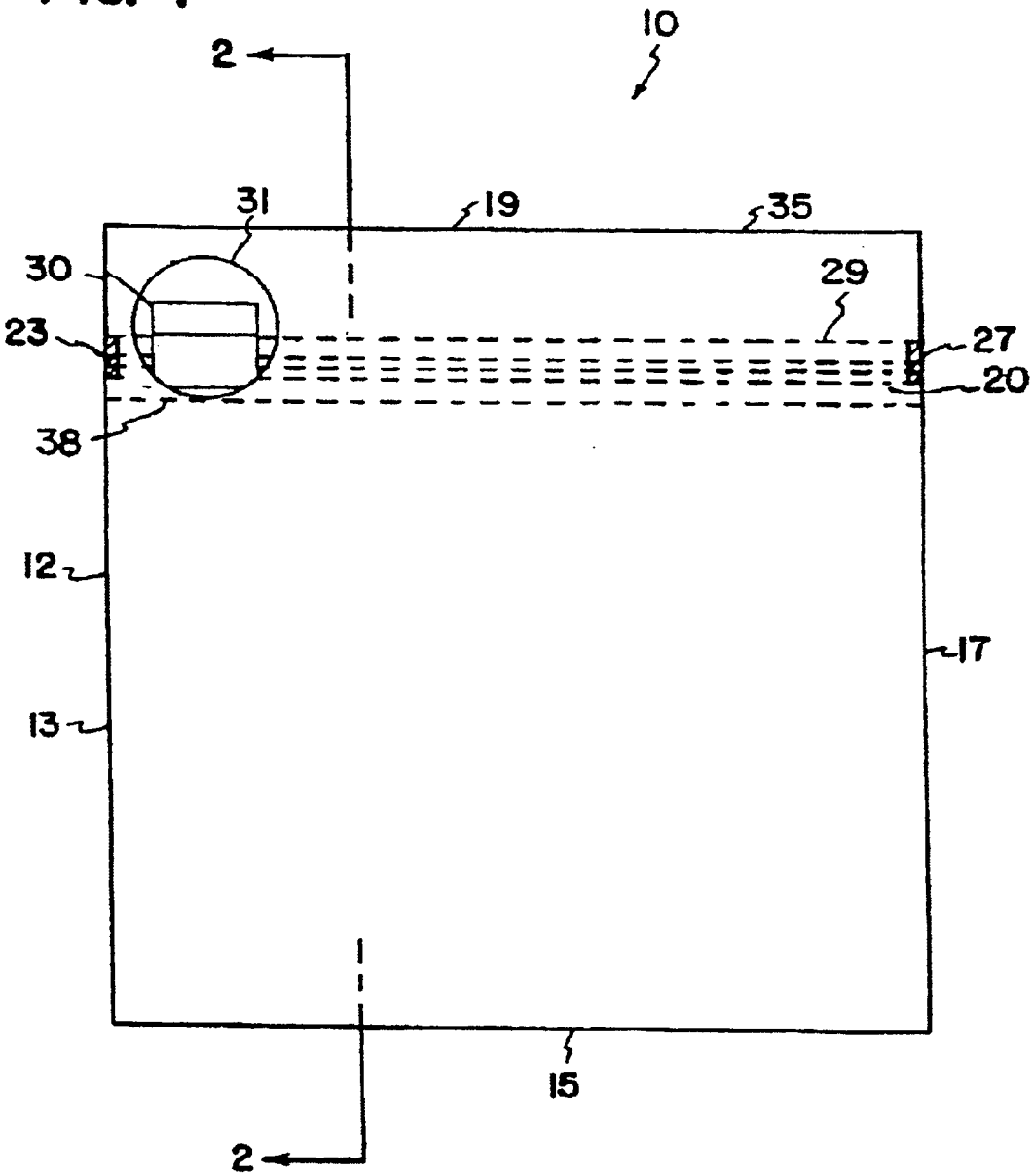
FIG. 1 is a front plan view of a first embodiment of a flexible, reclosable package having a slider device and a tamper-evident structure.
Figure 2:
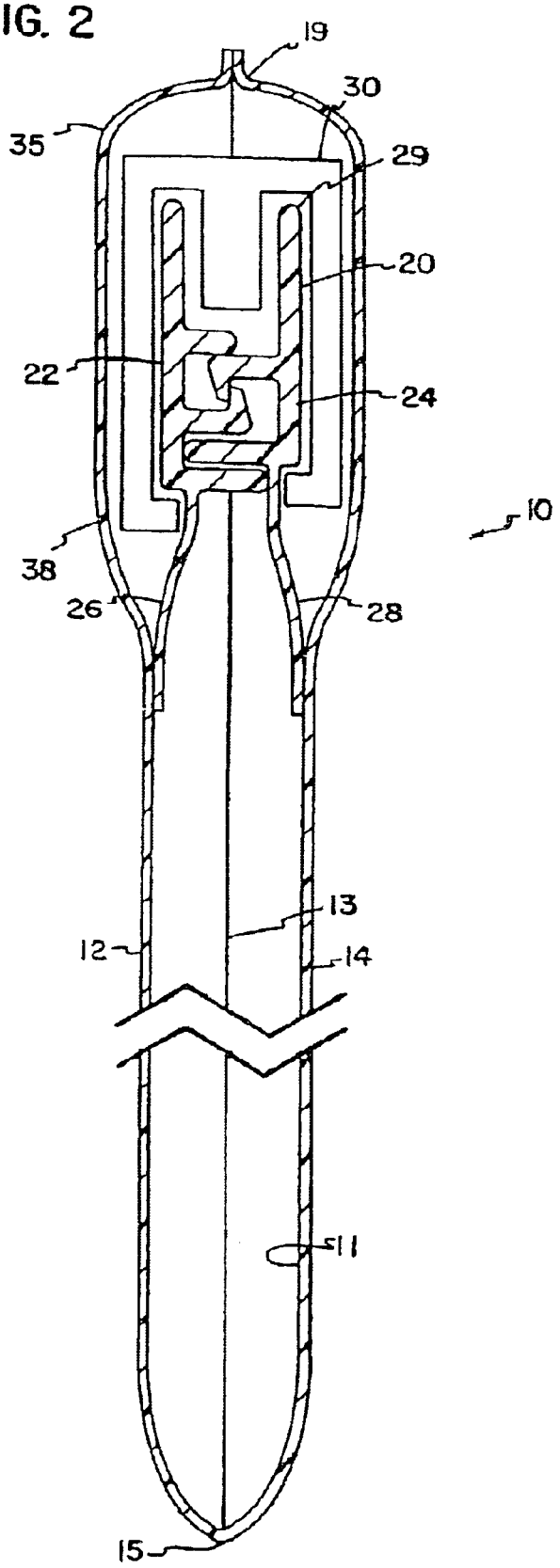
FIG. 2 is a cross-sectional view of the flexible, reclosable package taken along line 2—2 of FIG. 1.

A flexible, reclosable package 10 is shown in FIGS. 1 and 2. Package 10 includes four edges, a first side edge 13, a bottom edge 15, a second side edge 17, and a top edge 19. Providing the structure of package 10 are polymeric film side panels 12 and 14 (FIG. 2), which, with edges 13, 15, 17, define an interior 11, as best seen in FIG. 2.

Side panels 12, 14 are connected to each other at each of side edges 13, 17, bottom edge 15, and top edge 19. In FIG. 1, side edges 13, 17 are seals created by the application of heat and pressure to side panels 12, 14. As best seen in FIG. 2, bottom edge 15 is a fold line between side panels 12, 14, which is formed when a single sheet of film is folded to form the two side panels. In some embodiments, bottom edge 15 can be a seal created by the application of heat and pressure to side panels 12, 14.

A zipper closure arrangement 20 (shown partially in phantom in FIG. 1) having mating closure profiles to open and close (unseal and reseal) the package 10 extends from first side edge 13 to second side edge 17 in close proximity to top edge 19 of package 10, as seen in FIG. 1. The zipper closure 20 can include a variety of configurations and structures. Zipper closure 20 can be configured in any known manner, for example, such as disclosed in U.S. Pat. Nos. 4,240,241; 4,246,288; and 4,437,293; each of which is incorporated by reference herein. In FIG. 2, zipper closure 20 is illustrated with mating closure profiles such as a first mating profile 22 and a second mating profile 24. First mating profile 22 and second mating profile 24 engage and disengage, as appropriate, to open and close package 10. Still referring to FIG. 2, first and second mating profiles 22, 24 of zipper closure 20 are attached to the inside of side panels 12, 14, respectively, by sealing flanges 26, 28, respectively.

A slider device 30 is mounted on zipper closure 20 to facilitate opening and closing of zipper closure 20. Slider devices and how they function to open and close zipper closures, in general, are taught, for example, in U.S. Pat. Nos. 5,063,644; 5,301,394; 5,442,837, and 5,664,229, each of which is incorporated by reference herein. A preferred slider device is taught in U.S. patent application Ser. Nos. 09/365,215 and 29/108,657, both filed Jul. 30, 1999 and incorporated herein by reference in their entirety. Although shown schematically in FIGS. 1 through 4, slider device 30 is preferably constructed and arranged in accordance with the disclosures of the patent application Ser. Nos. 09/365, 215 and 29/108,657.

Two portions of zipper closure 20, one close to first side edge 13 and another close to second side edge 17, act as slider stop areas; these slider stop areas are preferably crushed, such as by ultrasonic crushing, at crush areas 23, 27 in FIG. 1. These slider stop areas or crush areas 23, 27 securely seal first and second mating profiles 22, 24 together to minimize the chance of slider device 30 sliding off the side edges 13, 17 of package 10. The slider stop areas or crush areas 23, 27 further minimize the tendency for slider device 30 to abut against either of first side edge 13 or second side edge 17.

A notch (not shown) is preferably disposed within zipper closure 20. The notch is designed to provide a "park place" into which slider device 30 settles when zipper closure 20 is sealed. Such a notch may decrease any tendency for an incomplete interlock between first mating profile 22 and second mating profile 24. Examples of notches are disclosed, for example, in U.S. Pat. Nos. 5,067,208 and 5,301,395, each of which is incorporated by reference herein.

In FIGS. 1 and 2, package 10 includes a tamper-evident structure 35 disposed at top edge 19 to retain slider device 30 close to first side edge 13 and preferably within any notch. By "tamper-evident", it is meant that it provides an indication to the consumer as to whether the package 10 has been previously opened. In order to access the interior 11 (FIG. 2) of package 10, the tamper-evident structure 35 needs to be penetrated. In the embodiment depicted in FIGS. 1 and 2, tamper-evident structure 35 covers and forms a complete enclosure around a majority of the zipper closure 20 while leaving slider device 30 exposed. As best seen in FIG. 2, tamper-evident structure 35 extends from below zipper closure 20 and encases and surrounds first and second mating profiles 22, 24 of zipper closure 20. Further, tamper-evident structure 35 extends from first side edge 13 (FIG. 1) along top edge 19 to second side edge 17 and encases the majority of zipper closure 20, but does not encase slider device 30. Rather, an opening 31 within tamper-evident structure 35, located close to first side edge 13 where slider device 30 is seated, provides access to slider device 30.

Opening 31 is shown in FIG. 1 as a circle which extends through both sides, that is, through first and second side panels 12, 14, of tamper-evident structure 35. Opening 31 can be any shape or size that is sufficiently large to allow a consumer to view slider device 30 and confirm that slider device 30 has not been moved so as to open zipper closure 20. Opening 31 can be a circle, an oval, a square, triangle, star, or any regular or irregular shape that is entirely defined by tamper evident-structure 35; that is, opening 31 is totally surrounded by tamper-evident structure 35. Opening 31 can extend through each of first and second side panels 12, 14, or can extend through only one of side panels 12, 14. In some embodiments, a portion of zipper closure 20 may be viewable through opening 31; however, it is preferred that the distance between slider device 30 and tamper evident-structure 35 (at the edges of opening 31) is no greater than about 2 cm, preferably no greater than about 1 cm. In another embodiment, this distance is no less than about 0.5 mm. Typically, the distance between slider device 30 and tamper-evident structure 35 is about 1 mm to 1 cm, and preferably is about 2 mm to 5 mm (0.5 cm).

Tamper-evident structure 35 is formed by sealing the tops of side panels 12, 14 over zipper closure 20 at top edge 19, as best seen in FIG. 2. Preferably, the seal along top edge 19 of tamper-evident structure 35 is continuous; that is, with no unsealed lengths between side panels 12, 14 along top edge 19. However, in some embodiments spot sealing along top edge 19 may be acceptable. Additionally, in some instances the seal may rip or tear, leaving small lengths of unsealed top edge 19. Each end of tamper-evident structure 35 is also preferably continuously sealed; that is, preferably tamper-evident structure is sealed along first side edge 13 and second side edge 17 so that access cannot be gained to zipper closure 20 through the ends of tamper-evident structure 35. In some embodiments, first and second side panels 12, 14 are sealed together around the entire circumference or perimeter of opening 31; in other embodiments, only portions around the circumference are sealed 32. Any sealing can be done by ultrasonic welding, thermal sealing, crushing, mechanical attachments, adhesive or solvent, or any combination thereof.

Slider device 30 is disposed within opening 31 and in some embodiments is limited to its position within opening 31 until tamper-evident structure 35 is removed. In order to gain access to the package interior 11, slider device 30 must be moved along zipper closure 20, which can only be done if tamper-evident structure 35 has been penetrated; typically tamper-evident structure 35 has to be removed. Tamper-evident structure 35 includes an area of weakness 38, which allows for easy removal of tamper-evident structure 35. In some package embodiments, area of weakness 38 is a perforation line, laser score, tear-strip, zip strip, or any type of weakened area that allows for easy removal of tamper-evident structure 35 to expose zipper closure 20 so that slider device 30 can be moved. Area of weakness 38 extends along the length of tamper evident-structure 35 and is positioned below zipper closure 20, to minimize any remnants of tamper evident-structure 35 that could interfere with the movement of slider device 30 along zipper closure 20.

When tamper-evident structure 35 is present over zipper closure 20, the true top edge 29 of package 10 is encased within tamper-evident structure 35. Typically, the top edge 29 is defined by first and second mating profiles 22, 24.

When tamper-evident structure 35 has been removed at area of weakness 38, the true top edge 29 is exposed and is the top most portion of package 10, not including slider device 30. There are no further film sections or other structures that extend above top edge 29.

Figure 4:
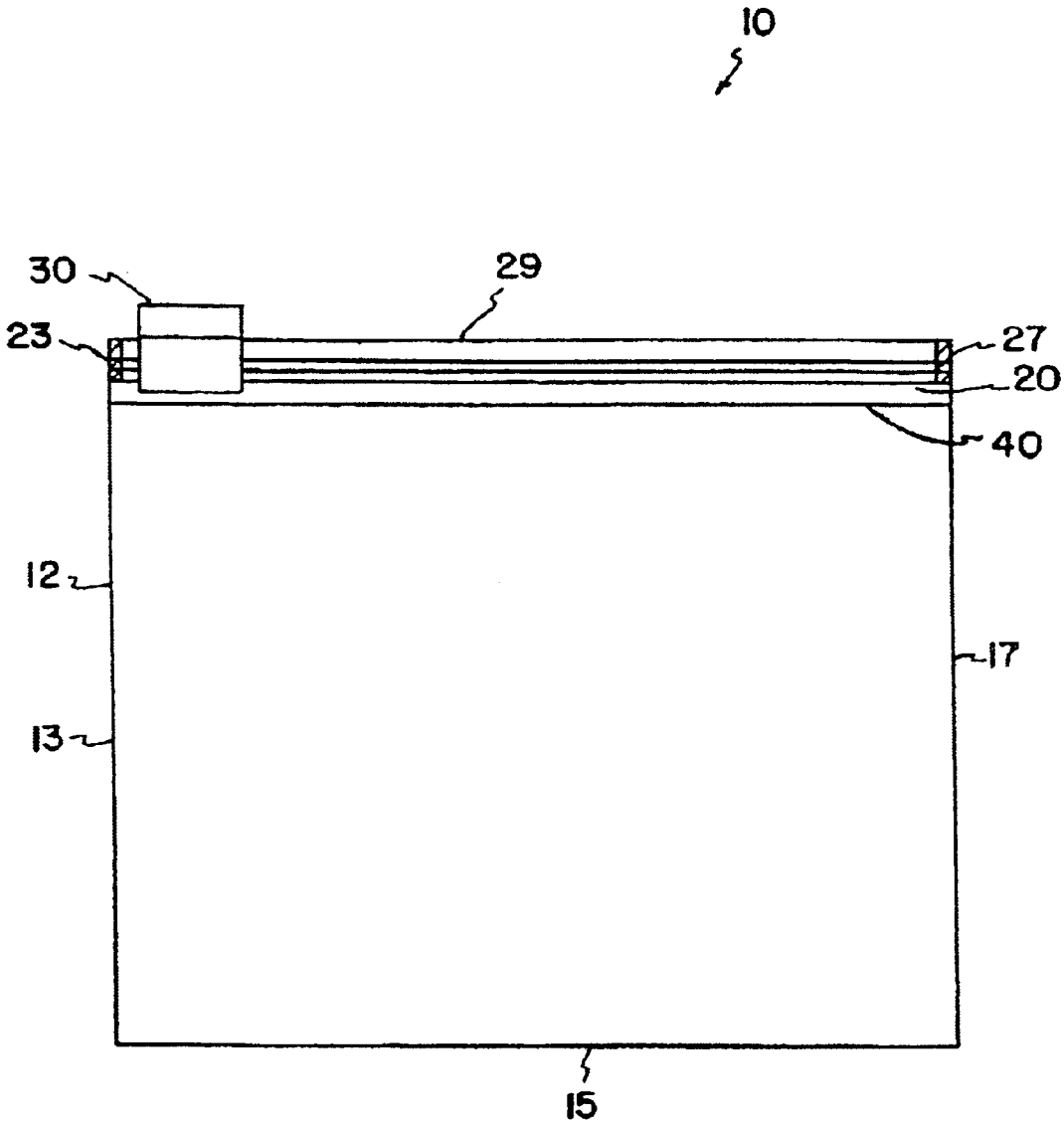
FIG. 4 is a front plan view of the flexible, reclosable package of FIGS. 1 and 2 with the tamper-evident structure removed.
Figure 5:
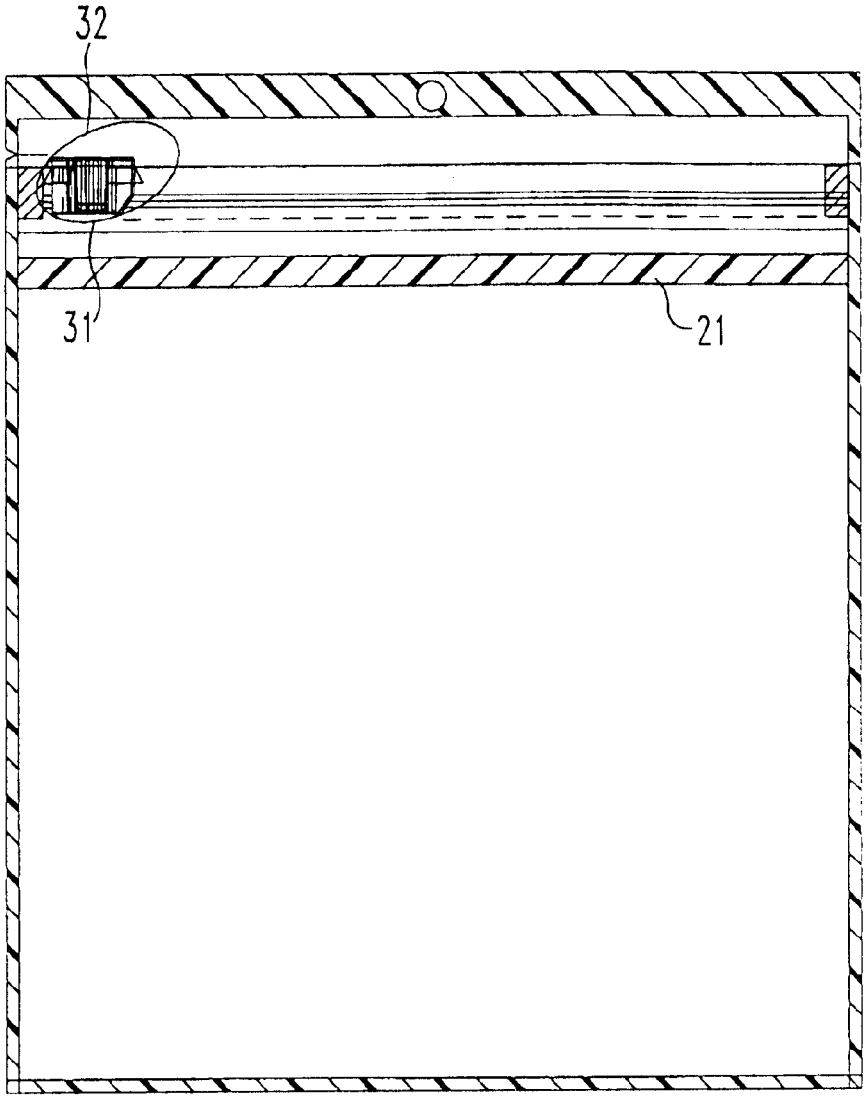
FIG. 5 is a front plan view of the flexible, reclosable package of FIG. 1 showing the peel seal, irregular shaped opening, and portions around the opening that are sealed.
Figure 6:
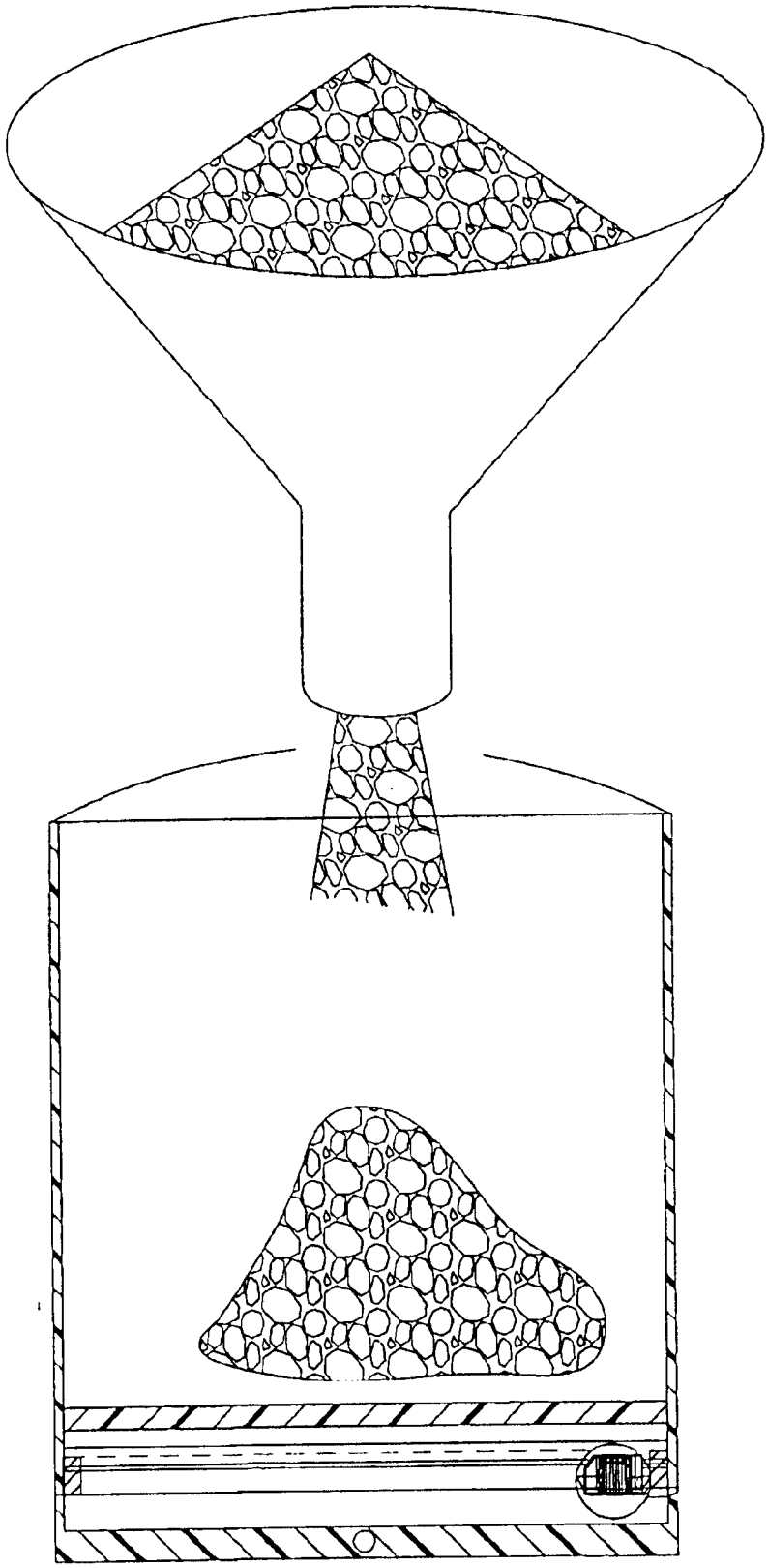
FIG. 6 is a front plan view of the flexible, reclosable package of FIG. 1 showing food in the package interior and a method of placing food in the interior.

FIG. 4 shows package 10 with tamper-evident structure 35 removed from over zipper closure 20. Top edge 29 is exposed and slider device 30 can be easily moved from first crush area 23 at first side edge 13 along zipper closure 20 to second crush area 27 at second side edge 17 to open zipper closure 20 and gain access to interior 11. Panel edge 40 is exposed where area of weakness 38 used to be. Note that when the tamper-evident structure 35 is removed, there is no significant amount of tamper-evident structure remaining above where area of weakness 38 used to be. There is no material left that may make physical contact with slider device 30 or might otherwise impair movement of slider device 30 along zipper closure 20.

Figure 3:
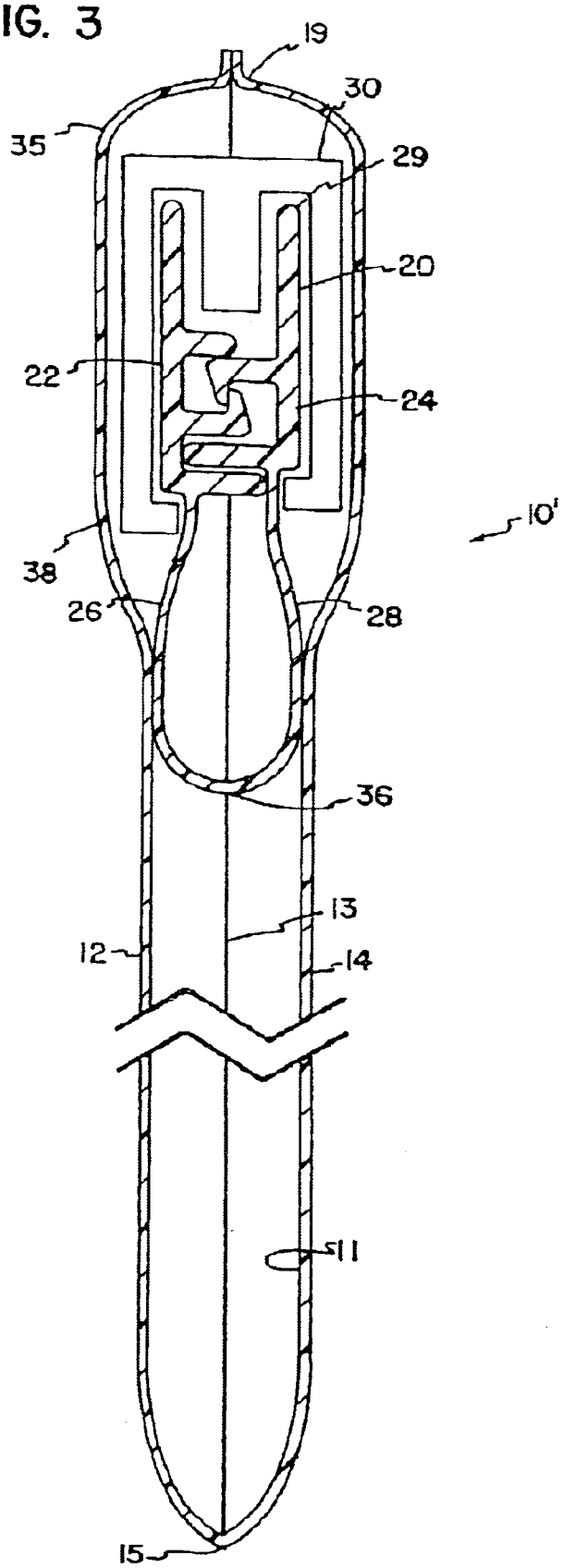
FIG. 3 is a cross-sectional view of a second embodiment of a flexible, reclosable package analogous to the view taken along line 2—2 of FIG. 1.

FIG. 3 illustrates a second embodiment of a package 10', similar to package 10 of FIGS. 1 and 2, except that a second tamper-evident structure is included. As illustrated in FIG. 3, a second tamper-evident structure 36 can be positioned between side panels 12, 14; this provides a second barrier that needs to be broken in order to gain access to interior 11 of package 10'. Generally, this second tamper-evident structure 36 is considered an internal tamper-evident structure, because it is positioned between zipper closure 20 and interior 11. Second tamper-evident structure 36, as shown in FIG. 3, is a web of material, preferably polymeric film, extending between sealing flanges 26, 28 of first and second mating profiles 22, 24 along the length of zipper closure 20. Penetration of this second tamper-evident structure 36 can be accomplished by using a perforation line, a tear bead, zip strip, or the like.

Alternately or additionally, a peel seal can be positioned between side panels 12, 13 or sealing flanges 26, 28 to provide a hermetic barrier for the interior 11. A peel seal 21 can be resealable; that is, it can be opened and resealed multiple times. Alternately, a peel seal 21 can be a single use seal, which, once broken, cannot be resealed. Examples of peel seals 21 are disclosed, for example, in U.S. Pat. Nos. 4,925,316 and 5,893,645, each of which is incorporated by reference herein.

Package 10, and package 10', can be manufactured by techniques generally known in the art of packaging. In one embodiment, side panels 12, 14 may be formed by a single sheet or web of material that has been folded to form bottom edge 15, or two sheets of material can be sealed at bottom edge 15 to form package 10, 10'. Zipper closure 20 is brought between side panels 12, 14 and sealing flanges 26, 28 (FIG. 2) of zipper closure 20 are sealed to side panels 12, 14. In some embodiments, for example to manufacture package 10' of FIG. 3, zipper closure 20 may have second tamper-evident structure 36 (FIG. 3) incorporated within.

A topmost portion of each of side panels 12, 14 is brought over to encase zipper closure 20 and slider device 30. By the term "topmost", it is meant the portions of side panels 12, 14 not defining interior 11 (FIG. 2); in another aspect, "topmost" is meant to refer to the portions of side panels 12, 14 that form tamper-evident structure 35. The topmost portions of side panels 12, 14 are sealed at top edge 19 (FIG. 2) and tamper-evident structure 35 is formed. Opening 31 can be provided in the topmost portions of side panels 12, 14 before or after the side panels are sealed to form tamper-evident structure 35. Opening 31 can be formed by die cutting, slitting, laser cutting, or by any such method.

Side edges 13, 17 are made typically by thermally sealing, and optionally cutting, side panels 12, 14. Side edges 13, 17 can be made before or after tamper-evident structure 35 is made.

To open the bag construction of FIGS. 1 and 2, and of FIG. 3, first tamper-evident structure 35 is removed by tearing along the area of weakness 38, providing access to the zipper closure 20 and slider device 30. This leaves a structure as shown in FIG. 4. The slider device 30 may then be moved from its position at first side edge 13 (FIG. 1) along zipper closure 20 to second side edge 17 (FIG. 1); movement of slider device 30 along zipper closure 20 unmates first and second mating profiles 22, 24 (FIGS. 2 and 3) and provides access to interior 11 (FIG. 2). For packages such as package 10' of FIG. 3, second tamper-evident structure 36 must be breached prior to accessing interior 11.

Having described the presently preferred embodiments, it is to be understood that the invention may be otherwise embodied within the scope of the appended claims.

What is claimed is:

1. A recloseable package comprising:

(a) polymeric film folded and sealed to define a package having an interior;

(b) a zipper closure comprising first and second mating profiles; the zipper closure being secured to the package to provide selective access to the package interior;

(c) a slider device operably mounted on the zipper closure and being moveable along the zipper closure;

(i) the slider device being constructed and arranged to interlock and disengage the first mating profile and the second mating profile in response to movement of the slider device along the zipper closure;

(d) the package having a top seal and a first tamper-evident structure;

(i) the top seal being adjacent to the zipper closure;

(ii) the first tamper-evident structure encasing a first portion of the zipper closure; and (iii) the first tamper-evident structure defining an opening exposing the slider device and a second portion of the zipper closure;

(A) the opening comprising a shape entirely defined and entirely surrounded by the first tamper-evident structure; and (e) a second tamper evident-structure positioned adjacent to the zipper closure.

2. A recloseable package according to claim 1 wherein:

(a) said polymeric film folded and sealed to define a package includes:

(i) first and second panel sections secured together to define a top edge; a bottom edge; and first and second side edges extending between the top edge and the bottom edge.

3. A recloseable package according to claim 2 wherein:

(a) said top seal is adjacent to said top edge.

4. A recloseable package according to claim 3 wherein:

(a) said second tamper-evident structure is positioned between the zipper closure and the bottom edge;

(i) the second tamper evident-structure being between the first panel section and the second panel section; and (ii) the second tamper evident-structure extending from the first side edge to the second side edge.

5. A recloseable package according to claim 4 wherein:

(a) said polymeric film includes an area of weakness extending between the first and second side edges of the package.

6. A recloseable package according to claim 1 wherein:

(a) the opening has a perimeter defined by end edges of the first tamper-evident structure; and (b) the slider device is spaced not more than 2 cm from at least a portion of the opening perimeter.

7. A recloseable package according to claim 6 wherein:

(a) at least selected portions of the perimeter of the opening are sealed together.

8. A recloseable package according to claim 1 wherein:

(a) the opening in the first tamper-evident structure comprises an irregular shape.

9. A recloseable package according to claim 2 wherein:

(a) the opening in the first tamper-evident structure comprises an irregular shape.

10. A recloseable package according to claim 6 wherein:

(a) the opening in the first tamper-evident structure comprises an irregular shape.

11. A recloseable package according to claim 1 wherein:

(a) the opening in the first tamper-evident structure comprises a circle.

12. A recloseable package according to claim 1 wherein:

(a) the second tamper-evident structure comprises a peel seal.

13. A recloseable package according to claim 1 wherein:

(a) the first portion of the zipper closure comprises at least 80% of the zipper closure.

14. A recloseable package according to claim 1 wherein:

(a) the first portion of the zipper closure comprises at least 90% of the zipper closure.

15. A recloseable package according to claim 4 wherein:

(a) the opening has a perimeter defined by end edges of the first tamper-evident structure;

(b) the slider device is spaced not more than 2 cm from at least a portion of the opening perimeter; and (c) the opening in the first tamper-evident structure comprises an irregular shape.

16. A recloseable package according to claim 15 further comprising:

(a) food in the package interior.

17. A method of making a package; the method comprising:

(a) providing a package body having an interior surface and defining a package interior; the package body having first and second sides, a top, and a bottom;

(b) attaching the zipper closure to the interior surface of the package body to extend between the first and second sides; the zipper closure having a slider device operably mounted thereon;

(c) forming a first tamper-evident structure over a portion of the zipper closure with the package body by:

(i) sealing the package body along the top to form a top seal and encase the zipper closure; the zipper closure being positioned between the top seal and the bottom;

(ii) forming an opening having an irregular shape in the first tamper-evident structure to expose the slider device in a position adjacent to the first side;

(A) the opening being entirely defined by the tamper-evident structure;

(B) the opening having a perimeter defined by end edges of the first tamper-evident structure; and (C) the slider device being spaced not more than 2 cm from at least a portion of the opening perimeter; and (d) providing a second tamper-evident structure between the zipper closure and the bottom.

18. A method of making according to claim 17 wherein:

(a) said step of providing a second tamper-evident structure includes providing a peel seal between the zipper closure and the bottom.

19. A method of making according to claim 17 wherein:

(a) said step of providing a second tamper-evident structure includes providing a web extension between opposing walls of the package body.

20. A method of making according to claim 17 further comprising:

(a) providing an area of weakness within the first tamper-evident structure.

21. A method of making according to claim 17 further comprising:

(a) placing food in the package interior.

* * * * *